US005435572A

United States Patent [19]

Covel

[11] Patent Number: 5,435,572

[45] Date of Patent: Jul. 25, 1995

[54] BALL KICK-TRAINING DEVICE

[76] Inventor: Richard A. Covel, 71 Taylor Rd., Stow, Mass. 01775

[21] Appl. No.: 204,665

[22] Filed: Mar. 2, 1994

[51] Int. Cl.[6] ..... A63B 69/00

[52] U.S. Cl. ..... 273/411; 273/55 B

[58] Field of Search ..... 273/55 B, 185 D, 57.2, 273/411

[56] References Cited

U.S. PATENT DOCUMENTS

| | | | |
|---|---|---|---|
| 1,377,127 | 2/1988 | Phys | 273/411 |
| 4,194,735 | 3/1980 | Wilson | 273/26 R |
| 4,307,888 | 12/1981 | Ohle | 273/413 |
| 4,440,400 | 5/1984 | Neuberger | 273/411 |
| 4,516,769 | 5/1985 | Kopp | 273/411 |
| 4,561,661 | 12/1985 | Walker | 273/411 |
| 4,616,834 | 10/1986 | Davis | 273/411 |
| 4,711,043 | 12/1987 | Johnson et al. | 36/139 |
| 4,720,095 | 1/1988 | Sowards | 272/77 |
| 4,865,330 | 9/1989 | D'Amico | 283/411 |
| 5,037,113 | 8/1991 | Sowards | 273/411 |
| 5,076,580 | 12/1991 | Lang | 273/26 R |
| 5,280,922 | 12/1994 | Jones | 273/411 |

*Primary Examiner*—Theatrice Brown

[57] ABSTRACT

A ball kick-training and practice device with a base having predesignated right and left support foot placement positions and elevated with respect to the foot placement position surfaces, a ball which is attached to a shock absorbing mechanism. The support foot placements are located in such a manner as to require the player assuming the proper foot and body kick positions relative to the ball. The raised ball allows a player to practice kicking the ball with optimum instep of the foot contact and minimal chance of toe stubbing. The shock absorbing mechanism absorbs the force of the practice kick and returns the ball to its initial position relative to the support foot placements so the practice process may be rapidly and consistently repeated. The ball kicking training device's right and left support foot placement positions provides for kick training for either foot utilizing one ball and one shock mechanism.

3 Claims, 5 Drawing Sheets

BALL KICK-TRAINING DEVICE

A. FIELD OF THE INVENTION

The present invention relates to an advance in athletic teaching and training devices and, more particularly, pertains to a new ball-kicking training and practice device for such sports as soccer, football, and rugby.

B. BACKGROUND OF THE INVENTION

In the field of athletic sports involving the use of various balls of various shapes, it has been the practice to employ a variety of ball holding, ball positioning, and ball tethering devices for the purpose of teaching proper kicking skills and also allowing an athlete to effectively perform repeated kick type physical maneuvers with respect to the ball for training. When the ball of concern is, for instance, a football "kicking tees" are utilized. When a ball of concern is a round ball, for example a soccer ball, the related art has devised ball tethering, holding, and position devices as may be found in U.S. Pat. Nos. 4,865,330 and 4,720,095 and 4,307,888 and 4,711,043.

None of the afore-referenced devices are, however, specifically directed to the concept of providing a soccer kick training device which is designed to make a player assume, simultaneously during the use of the training device, (1) the proper support foot position relative to the ball, (2) the proper thigh/calf leg kick stroke, (3) the proper contact of the instep of the foot to the ball, and (4) the repetitive consistency of such positions during the repeated kick training process. Soccer coaches have long recognized the value of the early learning of one of the main elements of the game of soccer: a proper, powerful, and accurate instep kick. Coaches, especially those of very young players, have struggled with players to initially teach them and then have them retain the proper support foot position next to the ball, the leg and calf kick stroke, and the kicking foot pointed toe position to allow the instep to contact the ball. Teaching such proper kicking technique is hampered by lack of novice player balance skills when standing on the support foot, often painful toe stubbing experiences when the novice player attempts to properly kick the ball with the instep and misjudges the ground clearance and stub his or her toes into the turf. The latter toe stubbing experiences may totally prevent a novice player's willingness to be taught or learn the important instep kick for fear of repeating the painful incident, Failure to learn the important instep kick often relegates young players to never develop the power and accuracy that would carry them on to a more rewarding playing career. The aforementioned problems with soccer kick training are even more exacerbated when coaches attempt to train players to kick properly with their non-dominant foot which, in the game of soccer, is necessary to fully enjoy and compete with higher skilled teams and players. Coaches and players may also face the problem of availability of time and space to practice such proper kicking methods.

The current invention seeks to simultaneously address the problems of support foot placement next to the ball, leg/calf kick stroke, proper instep of the foot and ball contact, avoidance of toe stubbing, dominant, non-dominant foot training and consistent, rapid and convenient learning. The current invention accomplishes these objectives (1) with a support foot pad to allow the player with only the proper placement position for the support foot relative to the ball and which also requires the player to assume the proper one foot balance position, and (2) by the resistance and limited stroke of the shock mechanism which forces the player to practice the proper thigh/calf "punch" kick, and (3) avoid toe stubbing by elevating the ball above the plane defined by the horizontal surface of the support foot pad. Once the player has trained on the invention and gained the knowledge, confidence, coordination, and feel of the proper kicking style the player will be better prepared to continue his training and practice on the field utilizing the proper kicking techniques.

A further object of the invention is to allow skilled players to develop kicking strength and stamina and to practice in restricted areas, indoors, and during inclement weather.

C. SUMMARY OF THE INVENTION

The current invention remedies the shortcomings of previous kick training devices by providing a kick training device directed to assist players in the rapid learning and repetitively executing and practicing the proper body/foot/ball positions and kick strokes. A ball kick training device is provided which has a base with a predesignated right and/or left support foot placement pads relative to the position of an actual or simulated ball striking surface, hereinafter simply referred to as the "ball," which facilitates proper body/ball positioning, a ball raised above the horizontal plane of the surface of the foot pad to facilitate the optimum instep of the foot to ball contact, an energy absorbing shock mechanism attached to the ball to absorb the force of the kick and to return the ball to its initial position relative to the foot placement pad so the practice kicking process may be repeated and, attached to the base, a fixed or removable handle for grasping to assist the inexperienced player in maintaining the proper one foot balance.

D. BRIEF DESCRIPTION OF THE DRAWINGS

The following is a brief description of the drawings.

FIG. 6A through E are views of a player executing the use of the invention.

Figure 7:
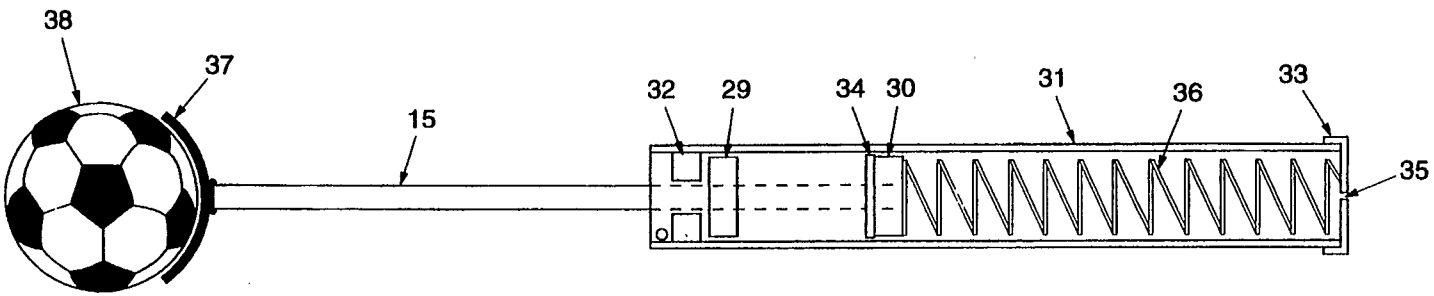

FIG. 7 is a cutaway side sectional view of an energy absorbing shock.

E DESCRIPTION OF THE PREFERRED EMBODIMENTS

Figure 1:
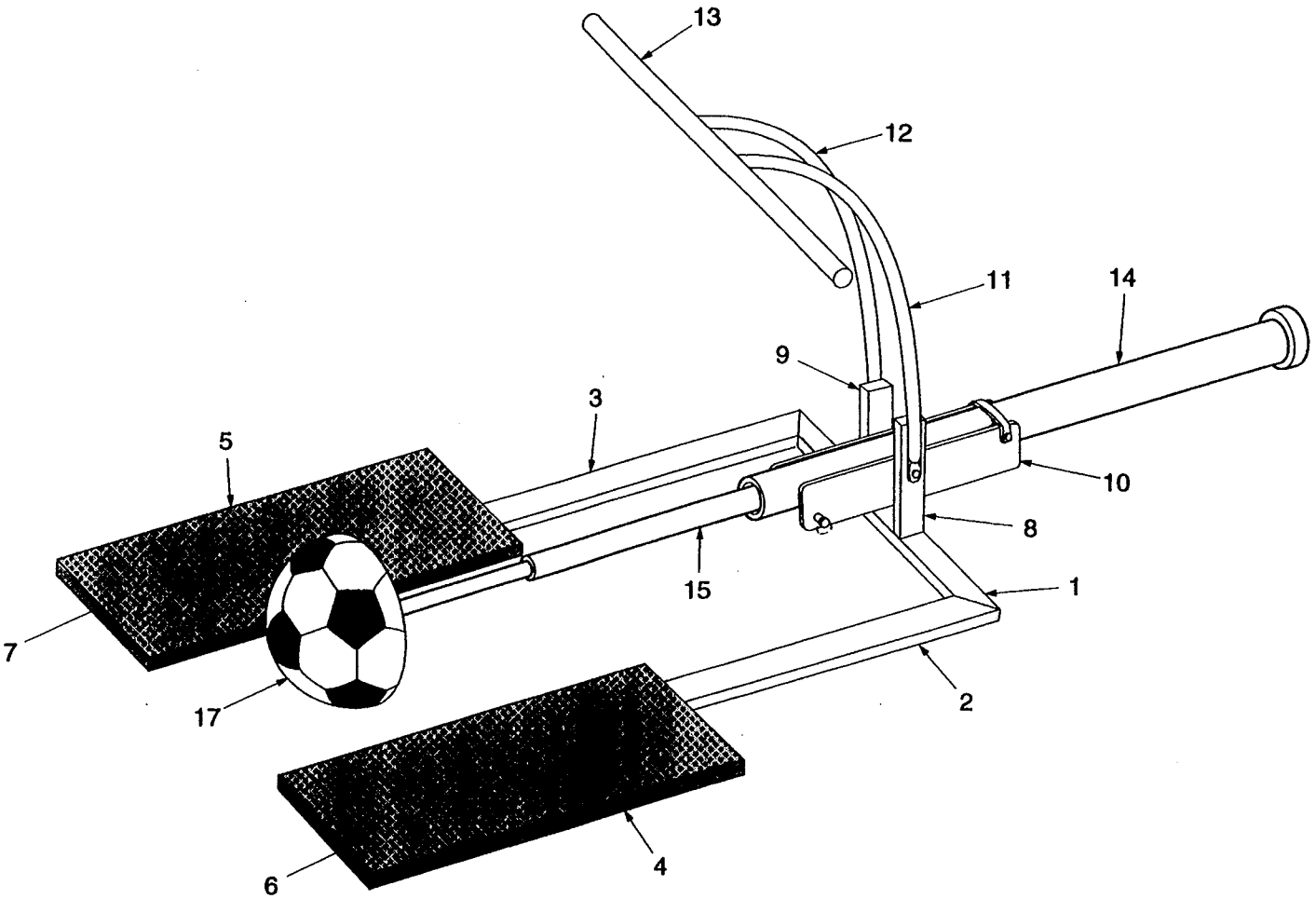
FIG. 1 is a perspective view a base, shock, ball, and handle.

The ball kick training device shown in FIG.1 has a U-shaped base I of wood, metal or other suitable structural material with right 2 and left 3 legs, a right support foot placement pad 4 attached to the end of the right base leg 2, a left support foot placement pad 5 attached to the end of the left base leg 3. The surface of the right and left support foot placement pads 6 and 7, respectively, are approximately 10" wide and 18" long and are covered with a non slip surface such as rubber, carpet, or artificial to provide grip to the players' shoes. Right and left support foot placement pads may be raised one to two inches above the floor or ground and are separated from each other horizontally by a distance of approximately the diameter of the ball of the game to be practice kicked. Upright base structural members 8 and 9 are attached to and extend vertically from the base leg I to support a shock absorber mount 10. Upright structural members 8 and 9 also may provide for the attachment position of handle vertical supports 11 and 12 to which horizontal handle 13 is attached to assist a player in maintaining balance when standing on the support foot placement pads. Shock absorber mount 10 provides support and alignment for shock absorber mechanism 14. Extending from shock absorber mechanism 14 is shock absorber rod 15 the length and stroke of which is approximately the length of a "punch-type" kick stroke or about 18–24 inches. Attached to shock absorber rod 15 is flange 16 (shown on FIG. 3) and ball 17 is attached to flange 16. Shock absorber 14 may be a hydraulically, pneumatically or spring controlled device with or without damping return controls to vary the speed at which the ball returns to its initial position and to vary the resistance to the kick compression stroke. The ball 17 may be an actual ball or a simulated ball shaped surface made of foam, rubber or other material to give the "feel" of the actual ball desired to be practiced with.

Figure 2:
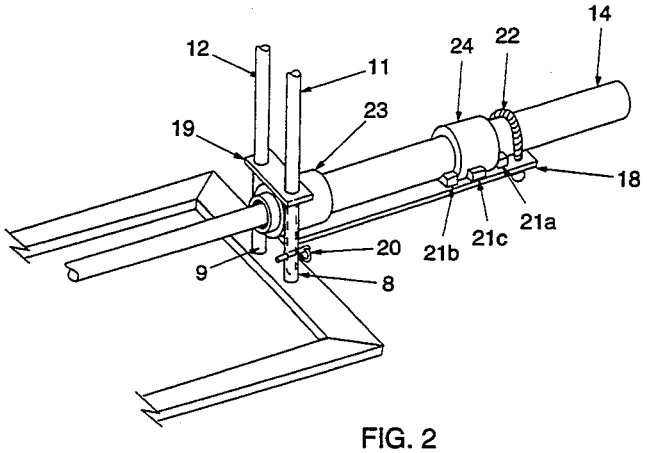
FIG. 2 is a perspective view of a shock mount.

FIG. 2 shows the details of a shock absorber mount having a mount base 18 fixed to tubular vertical supports 8 and 9. Vertical supports 8 and 9 extend upwards beyond the attachment point of mount base 18. Handle tubular vertical supports 11 and 12 pass through and are fixed to handle support brace 19 and fit inside tubular vertical supports 8 and 9, respectively, and are held in position by pin 20. Mount restraining blocks 21A, 21B, 21C and, juxtaposed to 21C, mount 21D, not shown, are fixed to mount base 18. Elastic or spring cylinder restraining cord 22 is fixed to mount base 18. Shock absorber mechanism 14 is provided with fixed forward resilient sleeve 23 of rubber or foam and rear sleeve 24. The enclosure defined by the interior space of the vertical supports 8 and 9, the mount base 18, and handle support brace 19 form the restrictive mount fixture for shock absorber forward resilient sleeve 23. The rear sleeve 24 fits in the interior space defined by restraining blocks 21A, 21B, 21C, 21D and the surface of mount base 18. Sleeve 24 is forcefully restrained in such position by restraining cord 18. Rear sleeve 24 transfers the force of the practice kicks to restraining block 21A. Should excessive downward or side forces on the ball occur, such as when a player falls on the ball or kicks it from an extreme improper sideways angle,respectively, then restraining cord 22 will be stretched so as to allow rear sleeve 24 to "jump out" of the space defined by restraining blocks 21A, 21B, 21C, and 21D and base 18 to prevent damage to the shock mechanism, rod, ball, and the player. Forward resilient sleeve 23 allows for the pivoting of the shock mechanism in the space defined by the vertical supports, base, and handle support brace due to its compression and resiliency.

Figure 3:
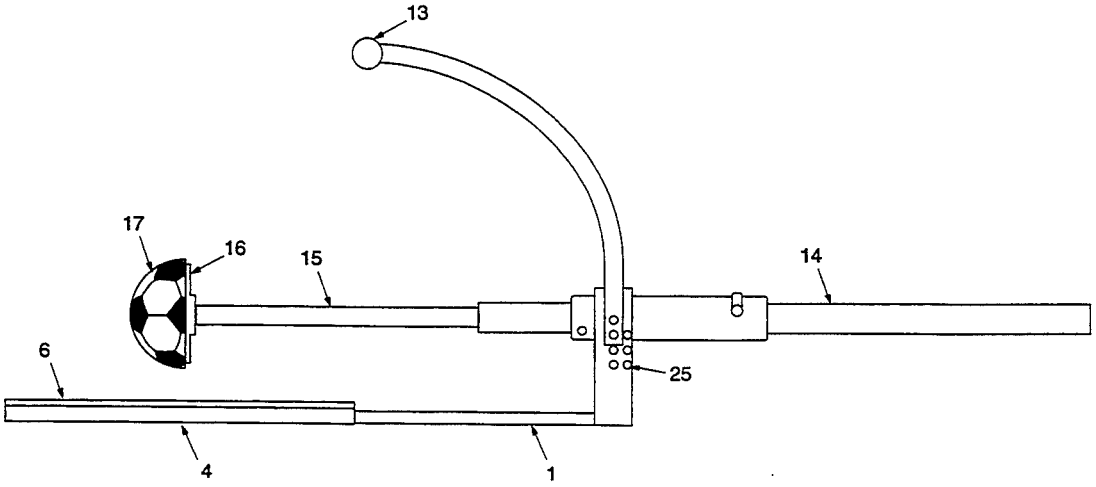
FIG. 3 is a side view of FIG. 1.

FIG. 3 is a side view of the invention showing the prekick initial position of the ball 17 relative to the right 4 foot pad. In the prekick position the center of the ball is located at approximately at the longitudinal mid point of the support foot pad which corresponds to the instep of a player's foot when such foot is placed on the pad. The top surface of the support foot pad 6 may be raised approximately one to two inches above the ground or floor on which the base rests. The initial positioning of the ball at approximately the longitudinal mid point of the support foot pad and the limited length of the pad forces the player to properly place their support foot at approximately the same longitudinal position as the ball or in coaching terms "next to" the ball. Such foot "next to" the ball position is necessary to also have the player's body "over" the ball. Without such proper foot/-body/ball positioning it is, because of the limited flexibility of the ankle joint, very difficult to strike a ball with the instep of the foot. Placing the foot too far "behind" the ball results in kicks with the toe and placing the foot too far "in front" of the ball usually results in no kick or a fall. The bottom of the ball is raised above the horizontal surface plane of the foot pad by preferably one inch, and in the case of raised foot pads approximately three inches above the surface on which the base rests, to allow a clear and unobstructed path for the toe of the kicking foot and thus avoid toe stubbing. Handle 13 provides for, if necessary, a steadying support for players first utilizing the invention. Handle 13 may be removed or adjusted in height and distance from the foot pads by utilizing the various mounting hole configurations 25 located in vertical uprights 8 and 9.

Figure 4:
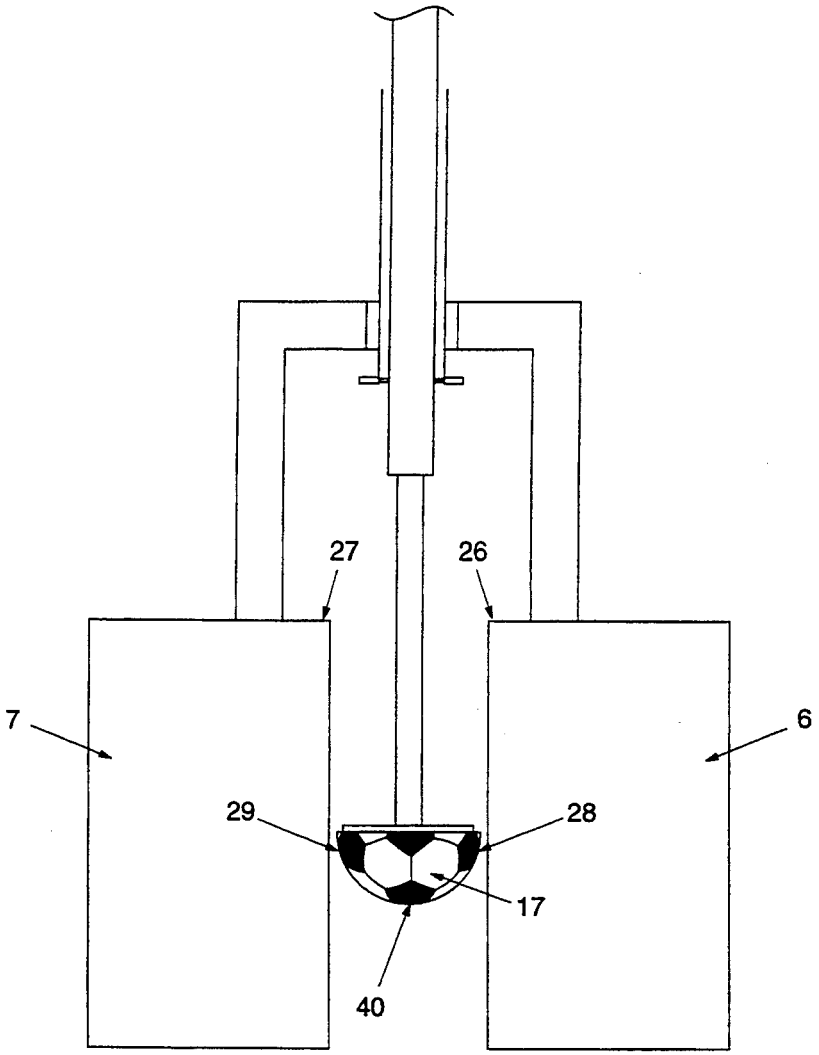
FIG. 4 is a top view of FIG. 1.

FIG. 4 shows again the relative position of the ball 17 and the surface of the foot pads 6 and 7 and the horizontal separation of the foot pads by preferably the diameter or width of the ball 17. Such positioning of the inner surfaces 26 and 27 of the foot pads adjacent to the right and left extremitive surfaces 28 and 29 of the ball 17 forces the player to not only stand longitudinally "next to" the ball's center but also allows the player to position support foot horizontally close to the nearest outer surface 28 or 29 of the ball 17. The surface dimensions of the foot pads, preferably 10 inches wide by 18 inches long, are also selected to limit the players pivot foot placement options to within the range "next to" and laterally close to the ball. FIG. 4 also identifies the front surface 40 of the ball.

Figure 5:
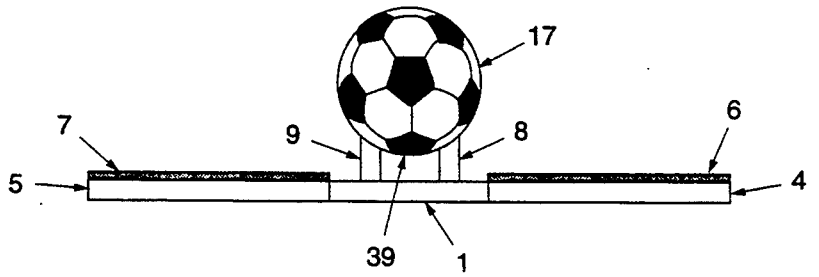
FIG. 5 is a front elevational view of FIG. 1.

FIG. 5 shows again the horizontal and vertical positioning of the ball 17 relative to the surface of the support foot pads 6 and 7. FIG. 5 shows the position of the ball 17 with the balls extremity 39 raised above the horizontal surface plane of foot pads 6 and 7.

Figure 6A:
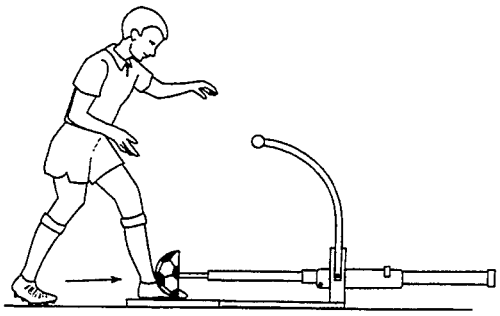
Figure 6B:
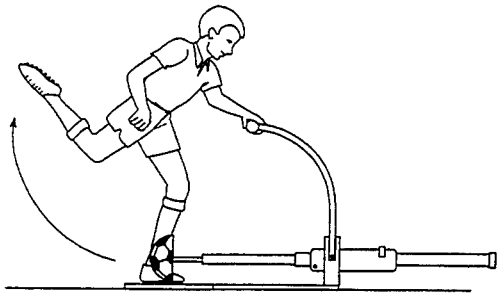
Figure 6C:
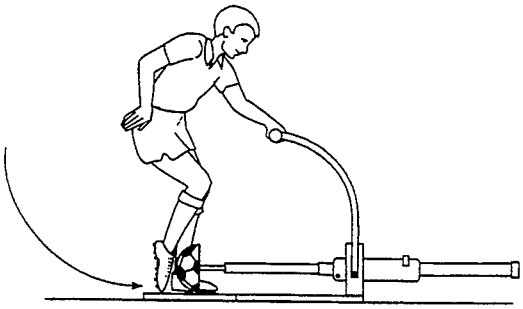
Figure 6D:
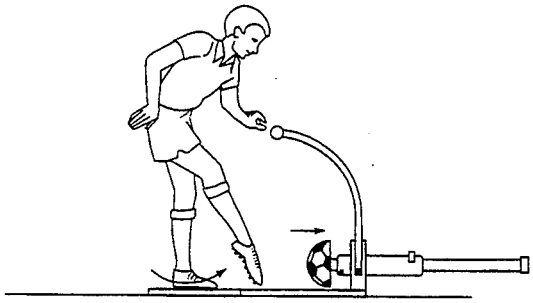

FIGS. 6A through E are illustrations of the sequence of the use of the invention. FIG. 6A illustrates a player approaching the invention and, because of the size and relative location of the left foot pad and the ball, first placing his left foot on the left foot pad properly "next to" the ball. FIG. 6B illustrates the player balanced on his left support foot and, in this illustration, utilizing the optional handle to assist in balancing his body in the proper position "over" the ball. The balance position is said to be "forced" because the player must step or hop up the foot pad and because of the size of the foot pad, the initial position of the ball, the limited stoke of the shock and the return of the ball to its initial position by the shock he must balance on one foot prior to, during and following the kicking exercise. This balancing promotes the proper "over" the ball kicking position and technique to effect the instep kick. FIG. 6B and illustrates the player having to raise his upper thigh and at the same time cock his calf high up to prepare to execute the proper "punch kick" with the instep of the foot. Because of the forced balance position it would be extremely awkward and imbalanced to execute a "straight legged" or "toe kick." Executing such improper kicks produces side loads on the piston rod, causes harsh travel of the ball and feeds back to the player an indication of improper kicking style and ball striking position. FIG. 6C illustrates the proper short "punch kick" with the instep of the foot contacting the ball at the proper mid center position of the ball to effect the maximum power, smoothness of shock action, and control from the kick. FIG. 6D illustrates the extent of the short follow through of the foot when properly executing the "punch kick". A long follow through such as used in a straight legged kick will be discouraged by the limited stroke of the shock. FIG. 6D also illustrates the ball and shock rod being forced into the shock thus absorbing the energy of the kick. The short follow through is essential for the punch kick as, like a Karate punch, it is a technique that is essential to effectively transfer the maximum amount of energy from the foot to the ball and to keep the ball trajectory low for passing, goal shots, and for placing spin on the ball. Once the player has mastered the short straight punch kick with its short follow through it is then easy for the player on the field to extend the follow through by a small distance to "raise" the trajectory of the ball to effect lofting passing longer distance kicks.

Figure 6E:
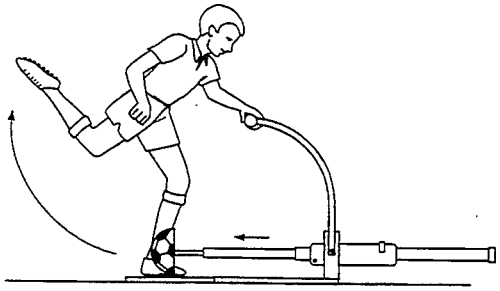

FIG. 6E illustrates the ball having been returned to its initial position and ready for another kick and the player returning his thigh, calf, and foot to their initial "cocked" position ready to execute another practice "punch kick." Utilizing the invention the process of the kick steps illustrated in FIGS. 6A through E can be repeated easily and quickly to train the player to execute the proper kick with the instep of both the right and left feet. Following such training the player can return to the turf to practice in actual field conditions. If necessary, the coach can return the player to the invention for further technique training. While the invention is designed to teach the instep kick it can also be utilized to practice the inside and outside of the foot kick.

FIG. 7 illustrates a shock absorbing mechanism with shock rod 15 with attached bushings; 29 and 30 supporting the shock rod 15 in alignment within the bore of a tubular shock body 31 which body has a bushing 32 attached to the tubular body at its open end and is closed at the opposite by flange or cap or other means 33. Shock rod 15 also has pneumatic seal 34. Such cap or flange 33 has a vent 35. Spring 36 is positioned inside the shock body between the cap or flanged end of the body and shock rod bushing 30 and by the springs compression the shock absorbs the energy of the kick and by the springs expansion the spring provides the energy to force to return the shock rod out of the shock body, to return the ball to its initial position repetitively because shock rod bushing 29 is restrained from further travel in such return direction by shock body bushing 32. Vent hole 34 bleeds off the air compressed during the kick stroke and bleeds in air during the return stroke. Sizing hole 34 allows for a controlled return speed on the return stroke. FIG. 7 also shows dished circular flange 37 with a spherical concave surface to receive a ball so as to allow the invention to utilize an actual ball 38 by adhering ball 38 to flange 37 with glue, epoxy, contact cement or mechanical fasteners.

While the above embodiments represent the current preferred embodiment of the invention, modifications thereof will occur to those skilled in the art within the spirit and scope of the invention. Accordingly, the invention is not to be construed as limited to the specific embodiments described above, except as defined by the appended claims.

What is claimed is:

1. A ball kicking training device comprising:

A base for placement on a support surface, said base having at least one raised horizontal foot support pad for placement of a players's foot, said foot support pad being substantially planar and having a toe end, a heel end an inside edge and an outside edge;

a ball having a predetermined diameter, said ball when placed for kicking defines a front extremity, a lower extremity and left and right extremities relative to said foot support pad;

support means supporting said ball in an initial prekick position with said ball being located above a horizontal plane defined by said foot support pad, said ball left and right extremities being a predetermined distance laterally from a vertical plane extending along and including said inside edge of said at least one foot support pad, and said front extremity of said ball being in said initial prekick position at a point between said heel and toe ends of said foot support pad;

said support means being a shock absorber mounted on said base so as to allow said ball to move substantially horizontal from said initial prekick position and in a direction away from the direction of the force of a kick and return to its initial prekick position ready for another kick; and handle means attached to said base for grasping by a player to assist the player in maintaining position and balance while kicking said ball.

2. A ball kick-training device set forth in claim 1, wherein there are right and left foot pads.

3. A ball kick-training device as set forth in claim 1 wherein the dimensions of the horizontal surface of the foot support pad is less than 10 inches in width and 18 inches in length.

* * * * *